US009863126B2

(12) United States Patent
Diaz et al.

(10) Patent No.: US 9,863,126 B2
(45) Date of Patent: Jan. 9, 2018

(54) SELF-ADJUSTING CONNECTOR APPARATUS FOR TELESCOPED GROUND ENGAGING WEAR AND SUPPORT MEMBERS

(71) Applicant: Hensley Industries, Inc., Dallas, TX (US)

(72) Inventors: Isai Diaz, Arlington, TX (US); Brandon Dunn, McKinney, TX (US)

(73) Assignee: Hensley Industries, Inc., Dallas, TX (US)

( * ) Notice: Subject to any disclaimer, the term of this patent is extended or adjusted under 35 U.S.C. 154(b) by 266 days.

(21) Appl. No.: 14/336,048

(22) Filed: Jul. 21, 2014

(65) Prior Publication Data

US 2015/0052787 A1 Feb. 26, 2015

Related U.S. Application Data

(60) Provisional application No. 61/868,838, filed on Aug. 22, 2013.

(51) Int. Cl.
*E02F 9/28* (2006.01)

(52) U.S. Cl.
CPC ..... *E02F 9/2883* (2013.01); *E02F 9/2841* (2013.01); *E02F 9/2858* (2013.01)

(58) Field of Classification Search
CPC ..... E02F 9/2841; E02F 9/2825; E02F 9/2833; E02F 9/2883; A01B 35/255; Y10T 403/32451; Y10T 403/32434; Y10T 403/32459
See application file for complete search history.

(56) References Cited

U.S. PATENT DOCUMENTS 1,620,132 A * 3/1927 Psilander ..... E02F 9/2825 37/454
2,385,395 A 9/1945 Baer
3,312,004 A 6/1964 Johnson
3,400,476 A 6/1965 Petersen
3,292,281 A * 12/1966 Petersen ..... E02F 9/2841 172/750
3,305,954 A * 2/1967 Troeppl ..... E02F 9/2841 37/457

(Continued)

FOREIGN PATENT DOCUMENTS

WO WO 2012/159155 11/2012

OTHER PUBLICATIONS

International Preliminary Report on Patentability issued for PCT/US2014/047937 dated Nov. 9, 2015, 6 pages.

(Continued)

*Primary Examiner* — Matthew D. Troutman
(74) *Attorney, Agent, or Firm* — Haynes and Boone, LLP

(57) ABSTRACT

Telescoped ground engaging telescoped wear and support members are provided with self-adjusting connector apparatus that releasably retains the wear member in a rearwardly telescoped orientation on the support member. In illustrated embodiments thereof, the connector apparatus includes cooperating ratchet structures operatively associated with the support and wear members and functioning to automatically re-tighten an abrasion-created loosened interfit between the wear and support members in response to a rearwardly directed operational force imposed on the wear member.

16 Claims, 5 Drawing Sheets

(56) References Cited

U.S. PATENT DOCUMENTS

| | | | | | |
|---|---|---|---|---|---|
| 3,536,147 | A | | 10/1970 | Norton | |
| 3,606,471 | A | * | 9/1971 | Evans | E02F 9/2841 299/112 R |
| 3,608,218 | A | * | 9/1971 | Sturgeon | E02F 9/2841 37/457 |
| 3,722,932 | A | | 3/1973 | Dougall | |
| 3,864,854 | A | * | 2/1975 | Evans | E02F 9/2841 175/413 |
| 4,154,483 | A | * | 5/1979 | Hollingworth | E21C 35/19 299/109 |
| 4,213,257 | A | * | 7/1980 | Johansson | E02F 9/2841 299/109 |
| 4,267,653 | A | * | 5/1981 | Hahn | E02F 9/2841 37/457 |
| 4,413,432 | A | | 11/1983 | Bierwith | |
| 4,663,867 | A | | 5/1987 | Hahn et al. | |
| 4,684,140 | A | * | 8/1987 | Olivieri | A63C 17/0086 280/11.26 |
| 4,762,372 | A | * | 8/1988 | Rassmann | E21C 35/19 299/108 |
| 5,311,681 | A | | 5/1994 | Ruvang et al. | |
| 5,465,512 | A | | 11/1995 | Livesay et al. | |
| 5,564,206 | A | | 10/1996 | Ruvang | |
| 5,718,070 | A | | 2/1998 | Ruvang | |
| 5,983,534 | A | * | 11/1999 | Robinson | E02F 9/2841 37/452 |
| 6,032,390 | A | | 3/2000 | Bierwith | |
| 6,085,448 | A | | 7/2000 | Gale et al. | |
| 6,315,058 | B1 | * | 11/2001 | Birkenbach | A01B 35/225 172/753 |
| 6,393,738 | B1 | | 5/2002 | Bierwith | |
| 6,415,533 | B2 | | 7/2002 | Bierwith | |
| 6,684,963 | B1 | * | 2/2004 | Poutre | A01B 35/225 172/750 |
| 6,724,906 | B2 | | 4/2004 | Naksen et al. | |
| 6,814,151 | B1 | * | 11/2004 | Peck | A01B 35/225 172/750 |
| 7,070,007 | B2 | * | 7/2006 | Poutre | A01B 35/225 172/750 |
| 7,124,836 | B2 | * | 10/2006 | Poutre | A01B 35/225 172/750 |
| 7,344,117 | B2 | | 3/2008 | She | |
| 8,215,202 | B2 | | 7/2012 | Tomandl | |
| 2005/0120823 | A1 | * | 6/2005 | Lin | B62K 11/14 74/551.1 |
| 2010/0162595 | A1 | | 7/2010 | Leslie et al. | |
| 2011/0000109 | A1 | | 1/2011 | Woerman | |

OTHER PUBLICATIONS

International Search Report and Written Opinion issued for PCT/US2014/047937, dated Apr. 2, 2015, 11 pgs.

* cited by examiner

SELF-ADJUSTING CONNECTOR APPARATUS FOR TELESCOPED GROUND ENGAGING WEAR AND SUPPORT MEMBERS

CROSS-REFERENCE TO RELATED APPLICATION

The present application claims the benefit of the filing date of provisional U.S. patent application No. 61/868,838 filed Aug. 22, 2013. The entire disclosure of the provisional application is hereby incorporated herein by this reference.

BACKGROUND OF THE INVENTION

In representatively illustrated embodiments thereof, this invention provides connector apparatus for telescoped ground engaging wear and support members. The connector apparatus is self-adjusting, to re-tighten the interfit between the wear and support members in response to operational forces imposed on the wear member.

A long standing practice in the ground engaging art is to protect a support member from operational abrasion wear by telescoping a replaceable wear member rearwardly onto a front portion of the support member (typically larger and more expensive than the wear member) to shield the wear member-covered portion of the support member from abrasion when the wear member/support member assembly is utilized in, for example, excavation, earth moving or mining operations. Examples of such telescoped wear member/support member combinations utilized in the ground engaging art include, but are not limited to, tooth point/adapter assemblies, base adapter/intermediate adapter assemblies, and shroud/bucket lip weld base assemblies.

For the wear member portion of the assembly to perform its abrasion shielding function, it must be releasably retained on the support member in a manner such that it will not be dislodged from the support member during ground engaging operations, yet is easily removable from the support member when the wear member is substantially worn away and needs to be replaced with a new wear member. Several well-known problems, limitations and disadvantages are commonly associated with conventional methods and apparatus utilized to retain a wear member on an associated support member.

For example, such retention is often effected using a spool member placed in aligned wear and support openings in the telescoped wear and support members, and a wedge which is then pounded into place in the openings into forcible engagement with the spool to retain the wear member on the support member. This requirement for pounding in a connector member is typically awkward and can sometimes be dangerous. Moreover, pounded-in connector components may be loosened during use of the wear member/support member assembly to an extent that the wear member falls off, becomes lost, and subjects the underlying support member to undesirable wear. Also, such loosening can undesirably permit the wear member to rattle back and forth on the support member. Undesirable loosening of the interfit between the wear and support members may also occur due to internal operational abrasion therebetween, with the pounded-in connector components typically being unsuitable for easily re-tightening this interfit.

As can readily be seen from the foregoing, a need exists for improved wear member/support member connector apparatus that eliminates or at least substantially reduces above-mentioned problems, limitations and disadvantages associated with conventional connector apparatus of the type generally described above. It is to this need that the present invention is primarily directed.

In carrying out principles of the present invention, in accordance with representatively illustrated embodiments thereof, telescoped wear and support members are provided with specially designed self-adjusting connector apparatus that releasably retains the wear member in its rearwardly telescoped orientation on the support member. As will be seen, in representative embodiments thereof the connector apparatus preferably includes cooperating ratchet structures operatively associated with the support and wear members and functioning to automatically tighten an abrasion-created loosened interfit between the wear and support members in response to a rearwardly directed operational force imposed on the wear member.

DETAILED DESCRIPTION

Figure 1:
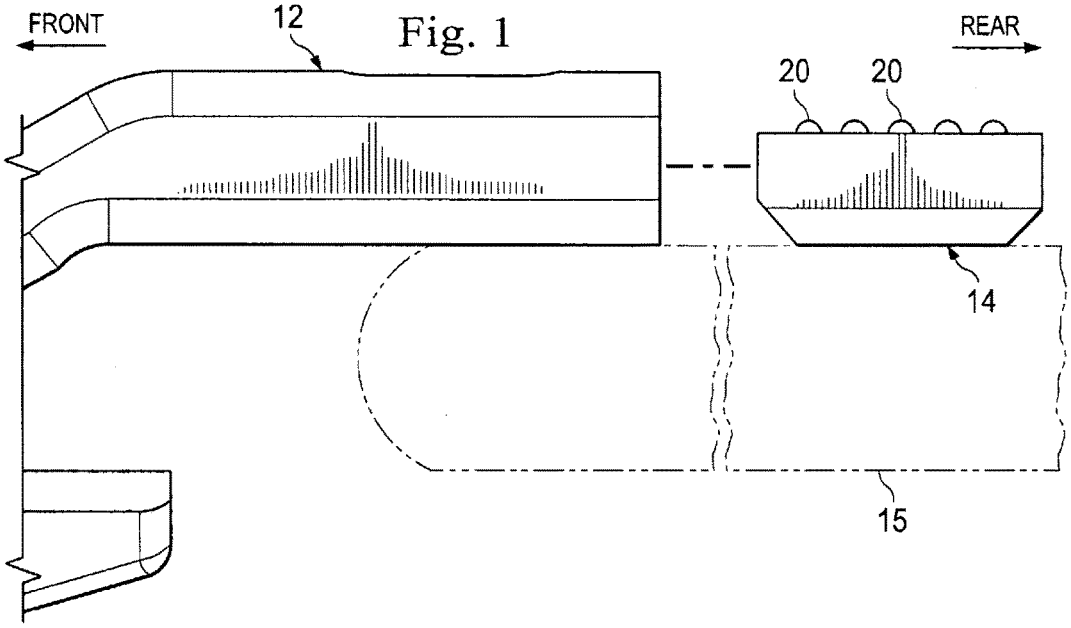
FIG. 1 is a longitudinally foreshortened, partially exploded side elevational view of a telescoped ground engaging wear member and support member assembly incorporating therein a self-adjusting interfit tightening structure embodying principles of the present invention.

Referring initially to FIGS. 1-5, in a first representatively illustrated embodiment of the self-adjusting connector apparatus one way ratchet teeth 10 (see FIGS. 3-5) are formed on a top side interior portion of a hollow wear member 12, illustratively in the form of a wing shroud, which is rearwardly telescoped onto a base member 14 (see FIGS. 1, 4 and 5) illustratively welded onto or otherwise secured to a support member 15 onto which the wear member 12 is also telescoped. Illustratively the support member 15 is in the form of a bucket lip to which the wear member 12 is releasably held by a specially designed interfit tightening structure 16 embodying principles of the present invention.

Other types of support members may be alternatively utilized without departing from principles of the present invention.

Figure 2:
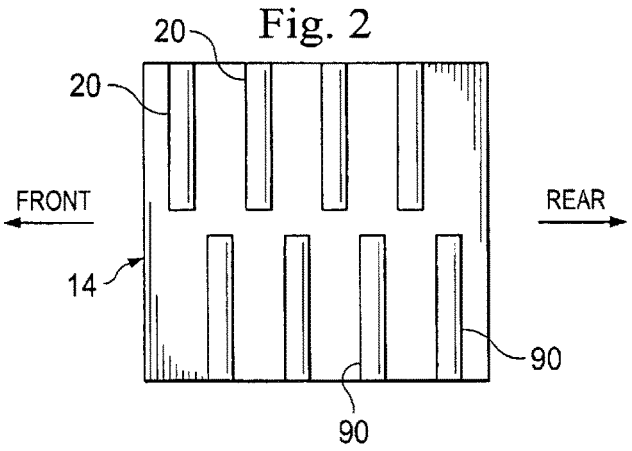
FIG. 2 is a top side view of a base member portion of the interfit tightening structure.
Figure 3:
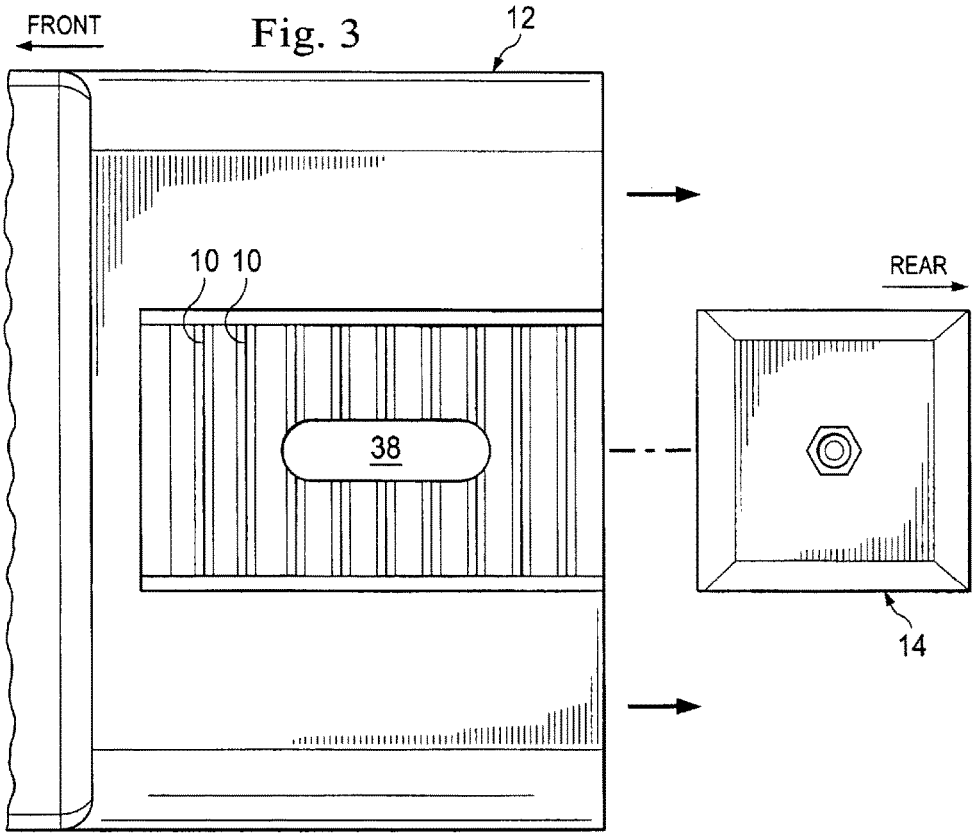
FIG. 3 is an exploded bottom side view of the wear member and base member as shown in FIG. 1.
Figure 4:
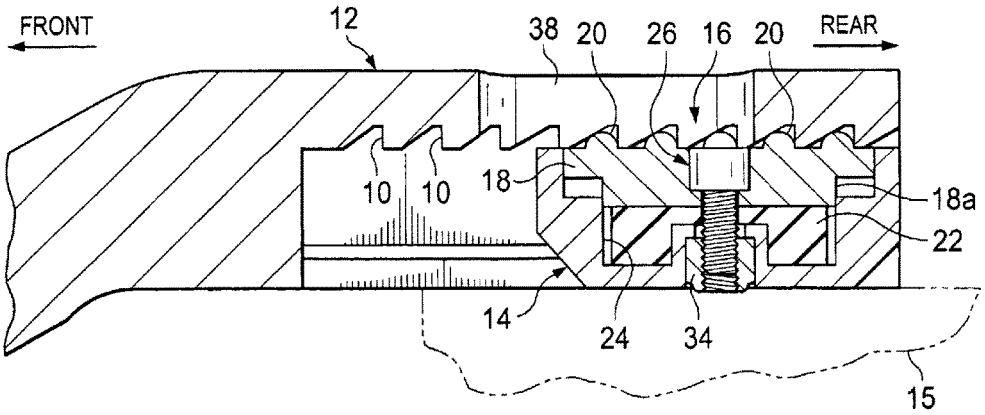
FIG. 4 is a cross-sectional view of the interfit tightening structure.
Figure 5:
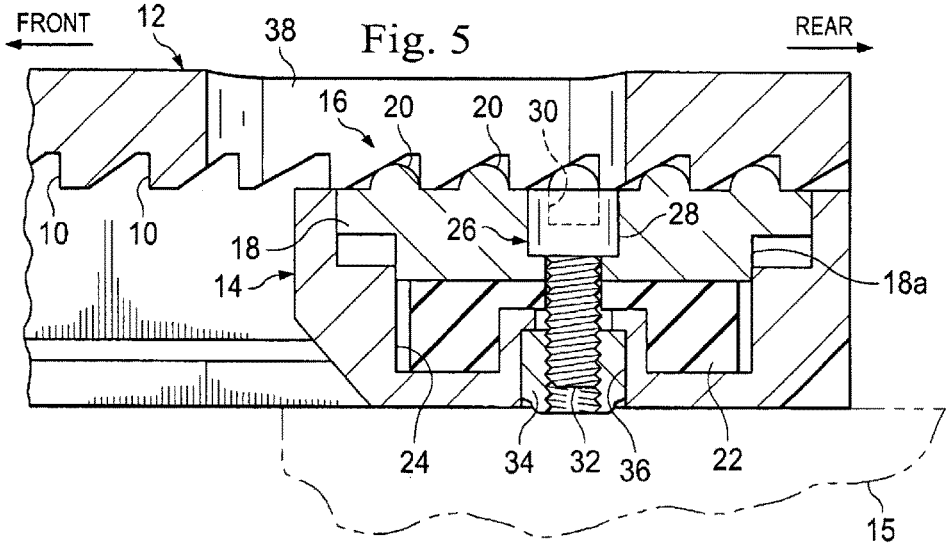
FIG. 5 is an enlarged cross-sectional view of a portion of the assembled interfit tightening structure.

Interfit tightening structure 16 (see FIGS. 4 and 5) includes the ratchet teeth 10, a vertically movable metal contact block 18 having a series of projections 20 formed on its top side in staggered rows as shown in FIG. 2, and an elastomeric member 22 underlying the block 18. The elastomeric member 22 and a reduced cross-section lower portion 18*a* of the contact block 18 are slidably received in a top side recess 24 of the base member 14.

A bolt 26 has a head portion 28 rotatably received in a top side opening of the contact block 18 and having a noncircularly cross-sectioned drive recess 30 therein, and a body portion 32 extending downwardly through the a bottom portion of the contact block 18 and the underlying elastomeric member 22 and threaded into a nut 34 (see FIG. 5) nonrotatably received in a lower side opening 36 of the support member 14. Tightening the bolt 26 vertically compresses the elastomeric member 22 and lowers the contact block 18, and subsequently loosening the bolt 26 relaxes the elastomeric member 22 and permits it to raise the contact block 18. Instead of the illustrated single nut 34, two nuts could be utilized to further assure that the bolt 26 stays in place during operation of the ground engaging apparatus.

With the elements 18, 22, 26 and 34 installed on the base member 14, and the bolt 26 tightened to lower the contact block 18 against the resilient force of the compressed elastomeric member 22, the wear member 12 is rearwardly telescoped onto the base member 14 (and also onto the support member 15) to an initially tightened orientation on the base member 14 and thus on the support member 15 as well. Using a suitable tool (not shown) moved downwardly through an access opening 38 in the top side of the wear member 12 and into the bolt head recess 30, the bolt 26 is then loosened to permit the contact block 18 to be raised by the underlying elastomeric member 22 in a manner causing the contact block projections 20 to upwardly enter corresponding ones of the gaps between adjacent pairs of the one-way ratchet teeth 10 of the wear member 12 (see FIG. 5). Due to the one-way configuration of the ratchet teeth 10, this prevents the installed wear member 12 from moving forwardly relative to the base member 14 and coming off the support member 15 to which the base member 14 is secured.

As the wear member/support member assembly 12,15 is utilized in ground engaging operations, operational abrasion wear between these elements will loosen the original interfit therebetween. However, when this interfit loosening reaches a certain extent, rearwardly directed operational forces on the wear member 12 will shift it rearwardly in a manner causing the projections 20 to rearwardly ratchet into the next available set of grooves between the one-way ratchet teeth 10, thereby again locking the wear member 12 against forward movement relative to the support member 15 and retightening the wear member 12 thereon.

A second interfit tightening structure embodiment 40 is shown in FIGS. 6-11 and is similar in operation to that of the previously described interfit tightening structure 16. Specifically, the interfit tightening structure 40 (see FIGS. 6, 7, 10 and 11) automatically functions to tighten a loosened interfit between a wear member 42, representatively in the form of a wing shroud, telescoped onto a base member 44 welded or otherwise secured to a support member 45 illustratively in the form of an excavating bucket lip, in response to rearwardly directed operational force exerted on the wear member 42.

Figure 6:
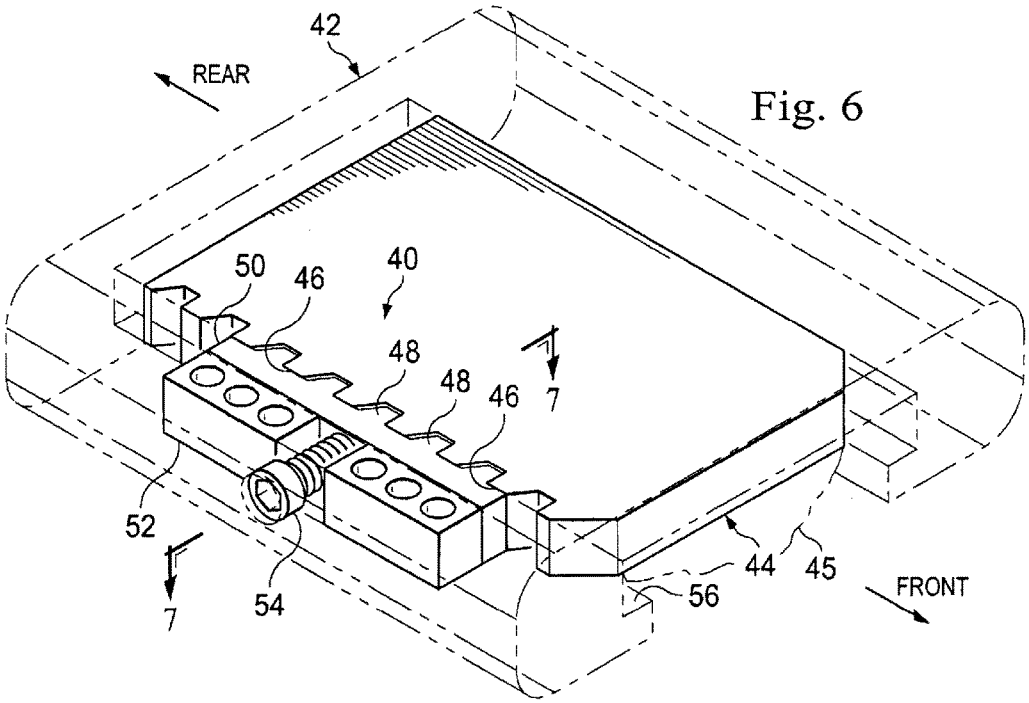
FIG. 6 is a cut away perspective view of a portion of a second wear member and support member assembly incorporating therein an alternate embodiment of the self-adjusting interfit tightening structure.
Figure 7:
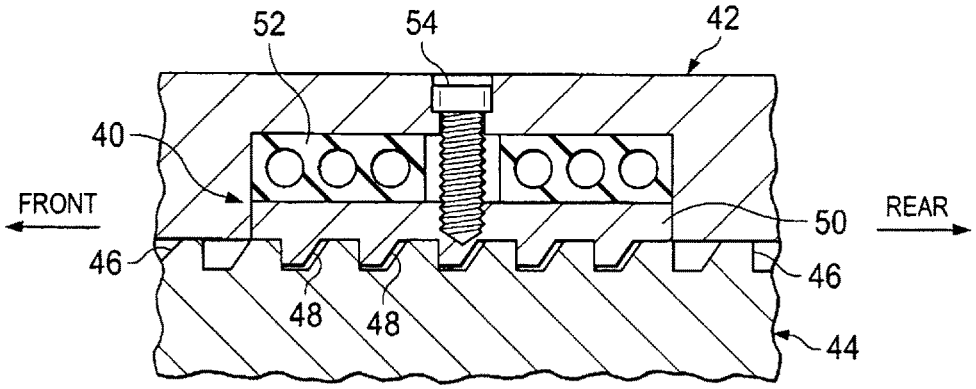
FIG. 7 is a cross-sectional view through a portion of the second wear member and support member assembly taken generally along line 7-7 of FIG. 6
Figure 10:
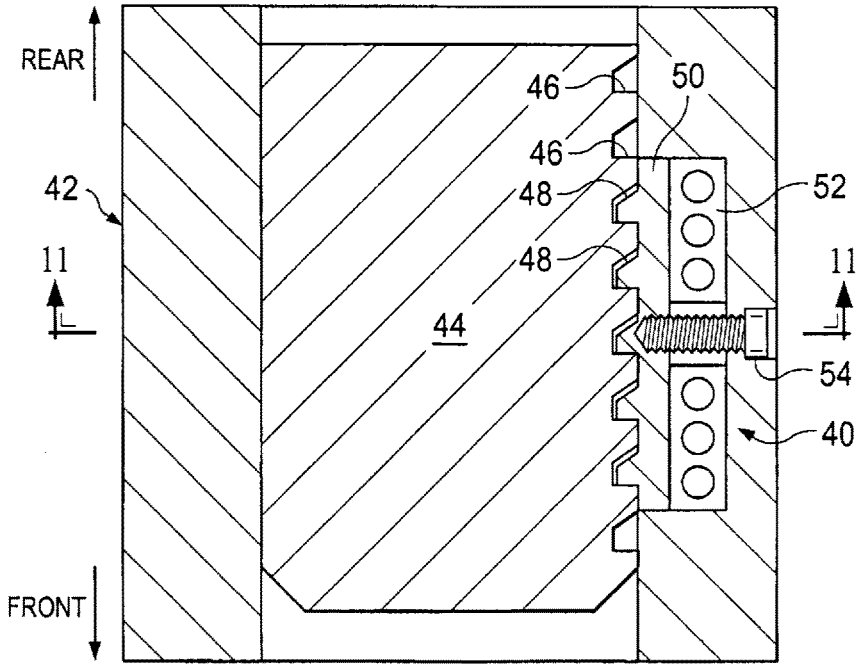
FIG. 10 is an upwardly directed cross-sectional view through a portion of the second wear member and support member assembly.
Figure 11:
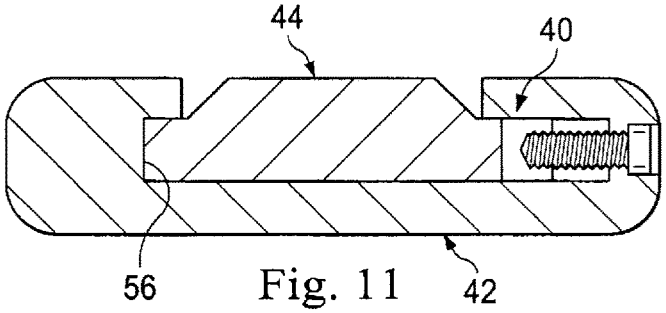
FIG. 11 is a cross-sectional view through the second wear member and support member assembly taken along line 11-11 of FIG. 10.
Figure 8:
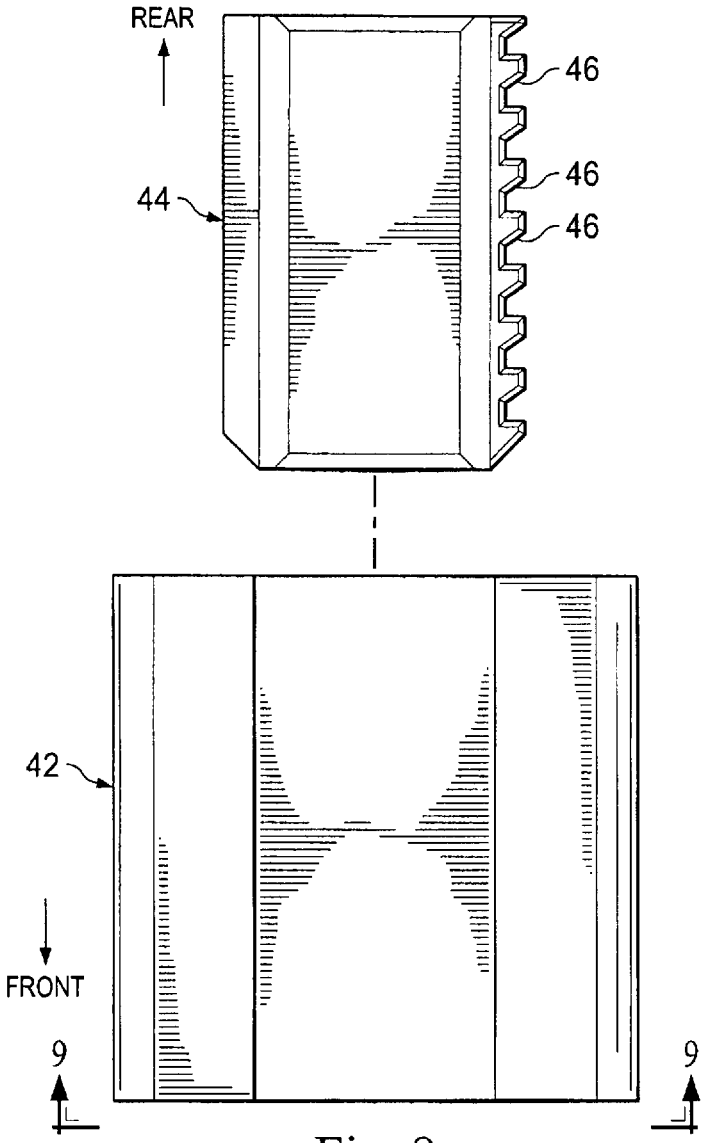
FIG. 8 is a partially exploded bottom side view of a portion of the second wear member and support member assembly.
Figure 9:
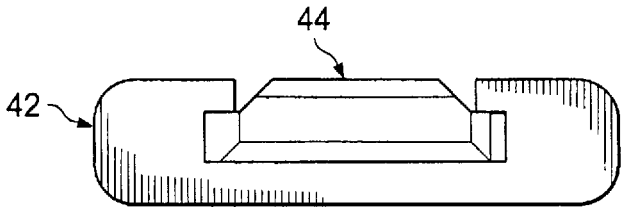
FIG. 9 is an end view of the assembled FIG. 8 components taken along line 9-9 of FIG. 8.

In this interfit tightening structure embodiment 40, however, a set of one-way ratchet teeth 46 (see FIG. 8 and) is formed directly on a right side edge portion of the base member 44 (as viewed in FIG. 10) and cooperates with projections 48 on a metal contact block 50 similar to the previously described contact block 18 and secured with an underlying resilient member 52 by a bolt 54 within an internal side edge recess 56 of the base member 44 (see FIG. 6). As can be seen in FIGS. 6, 7 and 10, rearward movement of the wear member 42 relative to the support member 44 caused by rearwardly directed operational forces on the wear member 42 ratchets it rearwardly to retighten it on the base member 44 and thus on the support member 45 to which the base member 44 is welded or otherwise secured. If desired, a second interfit tightening structure 40 (not shown) may be installed on the left side edge portion of the wear member 42 (as viewed in FIG. 10), with its projections 48 staggered in a front-to-rear direction relative to the projections 48 on the right side interfit tightening structure 40, for mating with one way ratchet teeth 46 (not shown) formed on the left side edge of the base member 44. As illustrated, the projections 48 may have one-way ratchet tooth configurations (as may the previously described projections 20).

As will be readily appreciated by those of skill in this particular art, the horizontally oriented interfit tightening structure depicted in FIG. 6 could be alternatively utilized in a vertical orientation, if desired, simply by rotating it ninety degrees in a manner placing the bolt 54 on the top side of the re-oriented interfit tightening structure.

While the representative embodiments of the present invention have been previously described herein in conjunction with a shroud structure connected to a weld base structure in turn secured to a bucket lip, principles of the invention are not limited to these illustrative types of wear and support members and could be utilized to advantage with a wide variety of other types of wear and support member combinations such as, for example, a tooth point and an adapter or an intermediate adapter and a base adapter.

What is claimed is:

1. Ground engaging apparatus comprising:

a support member;

a wear member rearwardly telescopable onto said support member; and interfit adjustment structure associated with said support member and said wear member and operable, when said wear member is rearwardly telescoped onto said support member to an initially tightened, fully seated position for ground engaging operations in which said wear member has a first interfit relationship with said support member, to:

(1) releasably prevent forward movement of said wear member relative to said support member away from said first interfit position of said wear member thereon while performing ground engaging operations, (2) permit rearwardly directed operational forces imposed on said wear member to rearwardly shift said wear member on said support member to a re-tightened second interfit position thereon when said first interfit relationship is operationally loosened, and then (3) releasably prevent forward movement of said wear member relative to said support member away from said second interfit position thereon;

wherein the interfit adjustment structure further includes a resilient structure and a tightening member operable to cause a rigid support structure to variably compress said resilient structure, the rigid support structure holding a first ratchet structure.

2. The ground engaging apparatus of claim 1 wherein said interfit adjustment structure includes:

a second ratchet structure respectively carried by one of: said support member and said wear member, the first ratchet structure being carried by the other of: said support member and said wear member.

3. The ground engaging apparatus of claim 2 wherein:

at least one of said first and second ratchet structures includes a set of one-way ratchet teeth.

4. The ground engaging apparatus of claim 3 wherein:

said first ratchet structure includes a set of one-way ratchet teeth.

5. The ground engaging apparatus of claim 3 wherein:

said second ratchet structure includes a set of one-way ratchet teeth.

6. The ground engaging apparatus of claim 3 wherein:

each of said first and second ratchet structures includes a set of one-way ratchet teeth.

7. The ground engaging apparatus of claim 1 wherein:

said tightening member is accessible through an opening in said wear member.

8. The ground engaging apparatus of claim 1 wherein:

said support member is a base securable to a bucket lip.

9. Ground engaging apparatus comprising:

a support member;

a wear member rearwardly telescopable onto said support member; and interfit adjustment structure associated with said support member and said wear member and operable, when said wear member is rearwardly telescoped onto said support member to an initially tightened, fully seated position for ground engaging operations in which said wear member has a first interfit relationship with said support member, to:

(1) releasably prevent forward movement of said wear member relative to said support member away from said first interfit position of said wear member thereon while performing ground engaging operations, (2) permit rearwardly directed operational forces imposed on said wear member to rearwardly shift said wear member on said support member to a re-tightened second interfit position thereon when said first interfit relationship is operationally loosened, and then (3) releasably prevent forward movement of said wear member relative to said support member away from said second interfit position thereon;

wherein said interfit adjustment structure includes cooperatively interengageable first and second ratchet structures respectively carried by said support member and said wear member;

wherein one of said first and second ratchet structures is resiliently biasable toward the other of said first and second ratchet structures; and wherein said one of said first and second ratchet structures is formed on a rigid support structure, and said interfit adjustment structure further includes a resilient structure and a tightening member operable to cause said rigid support structure to variably compress said resilient structure.

10. A ground engaging structure comprising:

a body with a recess formed therein and having an inner surface;

a resilient member disposed in said recess and positioned against said inner surface and having an outer surface;

a rigid member extending into said recess and contacting an outer surface of said resilient member, said rigid member having an outer side surface with a spaced series of projections formed thereon; and a tightening member operable to adjustably tighten said rigid member against said resilient member, the tightening member extending through the resilient member and connecting the rigid member to the base;

wherein said spaced series of projections are adapted to interlock with a ratchet structure of a rigid support structure such that rear movement of the rigid support structure with respect to the rigid member is allowed while forward movement of the rigid support structure with respect to the rigid member is prevented, the rear movement being away from a ground engaging end of the ground engaging structure.

11. The ground engaging structure of claim 10 wherein:

said ground engaging structure is a wear member.

12. The ground engaging structure of claim 11 wherein:

said wear member is a shroud.

13. The ground engaging structure of claim 10 wherein:

said ground engaging structure is a base member onto which a wear member may be telescoped.

14. The ground engaging structure of claim 13 wherein:

said base member is securable to a bucket lip.

15. The ground engaging structure of claim 10 wherein:

said projections are one-way ratchet teeth.

16. The ground engaging structure of claim 10 wherein the ground engaging structure includes a front and a rear, the recess opening in a direction transverse to a direction toward the front and a direction toward the rear.

* * * * *